United States Patent [19]

Brokaw

[11] Patent Number: 4,902,959

[45] Date of Patent: Feb. 20, 1990

[54] BAND-GAP VOLTAGE REFERENCE WITH INDEPENDENTLY TRIMMABLE TC AND OUTPUT

[75] Inventor: Adrian P. Brokaw, Burlington, Mass.

[73] Assignee: Analog Devices, Incorporated, Norwood, Mass.

[21] Appl. No.: 363,209

[22] Filed: Jun. 8, 1989

[51] Int. Cl.[4] ..... G05F 3/30

[52] U.S. Cl. ..... 323/314; 323/907

[58] Field of Search ..... 323/312, 313, 314, 315, 323/316, 907; 330/256, 257, 261, 288, 289; 307/310

[56] References Cited

U.S. PATENT DOCUMENTS

| | | | |
|---|---|---|---|
| 4,099,115 | 7/1978 | Watanabe | 323/314 |
| 4,100,437 | 7/1978 | Hoff, Jr. | 323/314 |
| 4,313,083 | 1/1982 | Gilbert et al. | 323/907 |
| 4,665,356 | 5/1987 | Pease | 323/314 |
| 4,677,369 | 6/1987 | Bowers et al. | 323/907 |
| 4,714,872 | 12/1987 | Traa | 323/314 |

*Primary Examiner*—Peter S. Wong

*Attorney, Agent, or Firm*—Parmelee, Bollinger & Bramblett

[57] ABSTRACT

An IC band-gap voltage reference including a pair of transistors having different emitter areas and driven by an amplifier feedback circuit to produce equal collector currents so as to develop an output voltage corresponding to the band-gap voltage. The amplifier output network includes a resistor network arranged to produce an output voltage which is a predetermined multiple of the band-gap voltage. The circuit provides for independent trimming of elements for adjusting the output voltage magnitude and its temperature coefficient.

20 Claims, 2 Drawing Sheets

BAND-GAP VOLTAGE REFERENCE WITH INDEPENDENTLY TRIMMABLE TC AND OUTPUT

BACKGROUND OF THE INVENTION

1. Field of the Invention

This invention relates to IC band-gap voltage references producing a DC output voltage compensated for changes in temperature. More particularly, this invention relates to such voltage references having improved performance, and further to voltage references which may readily be trimmed during manufacture to provide optimum performance characteristics.

2. Description of the Prior Art

A number of different band-gap voltage reference designs have been proposed, and some have gone into extensive use. One particularly successful design is a two-transistor cell such as shown in U.S. Pat. No. Re. 30,596 and U.S. Pat. No. 4,250,445, both issued to the present applicant. Another design, wherein the emitters of a pair of different-current-density transistors are connected together, is described in a paper presented at the 1981 IEEE International Solid-State Circuits Conference. A variation on that design appears in Linear Databook 2, 1988 Edition, published by National Semiconductor Corporation. While these designs have merit, they have not been fully satisfactory in certain respects. It is an object of this invention to avoid problems presented by prior art devices and techniques.

In a pending patent application Ser. No. 178,121 filed on Apr. 6, 1988 by the present inventor, there is disclosed a high performance amplifier employing as its input stage a matched differential pair of transistors. In the last paragraph of the specification of that application, it is suggested that the input matched pair could be replaced by a mismatched pair to develop a proportional-to-absolute-temperature (PTAT) current for a band-gap reference circuit. The preferred embodiment of the present invention to be described hereinbelow is generally of that proposed configuration, and combines the unique amplifier concepts disclosed in that earlier application together with voltage reference elements to provide superior performance characteristics.

SUMMARY OF THE INVENTION

In a presently preferred embodiment of this invention, described hereinbelow in detail, there is provided a differential pair of transistors having unequal emitter areas and with their bases driven by an amplifier feedback circuit in such a fashion that the transistor currents are maintained equal. The resulting difference in base-to-emitter voltages ($\Delta V_{BE}$) of the two transistors drives the transistor bases. This network also includes a appears across a part of the amplifier output network which diode to supply the requisite $V_{BE}$ voltage to be summed with the $\Delta V_{BE}$ component to produce the band-gap voltage as is necessary to provide zero temperature coefficient (TC) for the output voltage. The special design features of the amplifier provide important operational advantages for the band-gap voltage reference.

The amplifier output network includes two resistor strings both of which are connected to the reference output terminal, and which are so-interconnected that the reference output voltage is developed as a predetermined multiple of the bandgap voltage. Additionally, this network is so arranged that the output voltage and the temperature coefficient are determined by separate elements of the network, and means are provided for isolating those separate elements to permit them to be adjusted independently, thereby avoiding interaction during the trimming procedure used at the time of manufacture.

Other objects, aspects and advantages of the invention will in part be pointed out in, and in part apparent from, the following description of presently preferred embodiments of the invention, considered together with the accompanying drawings.

DESCRIPTION OF PREFERRED EMBODIMENTS

Figure 1:
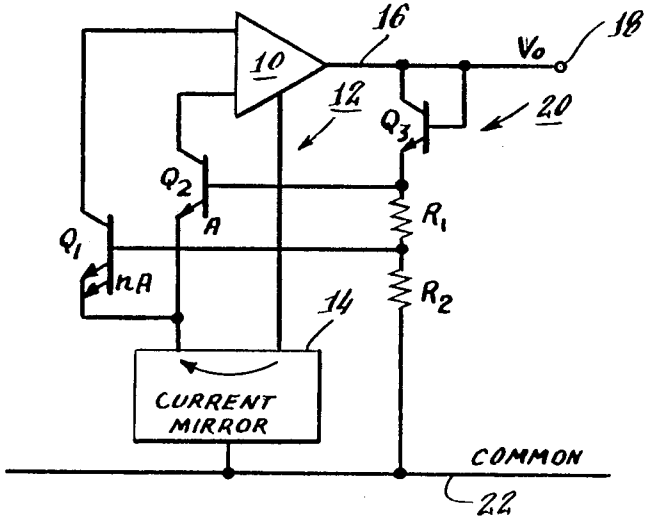
FIG. 1 is a circuit diagram showing one configuration for a basic voltage reference in accordance with this invention.

Referring now to FIG. 1, there is shown a circuit diagram including a pair of NPN transistors $Q_1$, $Q_2$ the emitters of which are connected together, and the collectors of which are connected as differential inputs to a transistor amplifier 10. This amplifier preferably is like that shown in copending application Ser. No. 178,121, filed Apr. 6, 1988, by the present inventor. The amplifier shown in that application includes an input pair of differential transistors which, like transistors $Q_1$, $Q_2$, have their emitters connected together. However, the input differential pair in that application is a matched pair, whereas in the present invention the transistors $Q_1$, $Q_2$ are predeterminedly mismatched, in that their emitter areas are unequal in a ratio of n:1. For example, $Q_1$ may have an emitter area which is 8 times that of $Q_2$. The reason for such unequal emitter areas will become apparent as the description proceeds.

The amplifier 10 is, like the amplifier in copending application Ser. No. 178,121, provided with a feedback biasing circuit, generally indicated in FIG. 1 at 12. This biasing circuit includes a current mirror 14 connected to the common emitters of the transistor pair $Q_1$, $Q_2$. This current mirror forces the combined current through both transistors to closely track the output of the amplifier 10 and, as explained in the above-identified pending application, thereby provides important advantageous characteristics.

The output 16 of the amplifier 10 is connected to an output terminal 18, and also to a network 20 including a diode-connected transistor Q3 in series with a pair of resistors $R_1$, $R_2$ returned to a common lead 22. The voltage developed across $R_1$ is connected as a differential feedback signal driving the bases of the transistors $Q_1$, $Q_2$This feedback control loop will be in equilibrium when the collector currents of $Q_1$, $Q_2$ are equal. Since the emitter areas of these transistors are unequal (by a ratio of n:1), equilibrium will occur when the voltage between the bases is given by: $\Delta V_{BE}=kT/q \ln n$, where T is absolute temperature.

Since kT/q is proportional-to-absolute-temperature (PTAT), there will be a PTAT current in $R_1$ when equilibrium is achieved. This current also flows in $R_2$, providing a larger PTAT voltage across both resistors $R_1$ and $R_2$. The output voltage Vo will be the sum of this larger voltage and the $V_{BE}$ voltage of $Q_3$. The output voltage Vo can be made temperature invariant by setting the values of $R_1$ and $R_2$ to make Vo equal to the band-gap voltage (for Silicon, about 1.205 volts), in accordance with known principles of band-gap voltage references.

Figure 2:
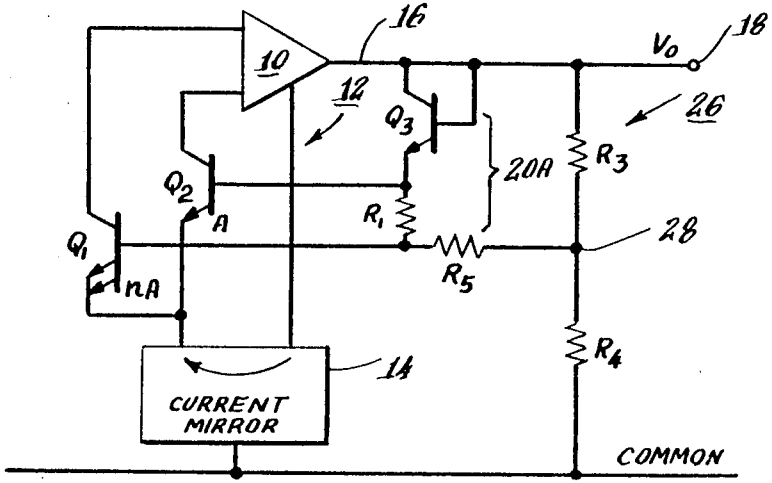
FIG. 2 is a circuit diagram like the arrangement of FIG. 1 but with a modification providing improved results.

The arrangement of FIG. 1 will have zero TC only when the output voltage Vo is equal to the band-gap voltage. However, it frequently is necessary to provide a regulated output voltage greater than the band-gap voltage. FIG. 2 shows an arrangement for accomplishing this. It is similar to the circuit of FIG. 1, but is so arranged that the equilibrium condition described above occurs at an output voltage greater than the band-gap voltage.

The FIG. 2 circuit in effect multiplies the band-gap voltage by a predetermined factor. This multiplication results from an additional resistor string 26 comprising resistors $R_3$, $R_4$ connected between the output terminal 18 and common. The common node 28 between those resistors is connected to network 20A comparable to the network 20 previously described, but wherein $R_2$ has been replaced with a different-valued resistor $R_5$. With this arrangement, the resistor values $R_3$, $R_4$ can be chosen to make the output voltage Vo any selected multiple of the band-gap voltage.

Figure 3:
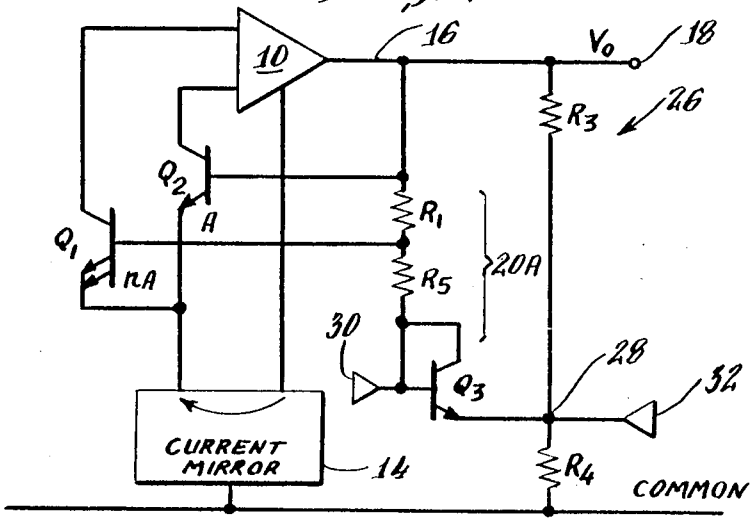
FIG. 3 is a circuit diagram like the arrangement of FIG. 2 but further modified to achieve additional improvement.

Although the circuit of FIG. 2 can provide the desired larger-than-band-gap output voltage Vo, it does not offer any way to independently trim the resistor values to obtain zero TC at a particular desired output voltage Vo, in the (probable) event that the nominal values of the resistors, or the $V_{BE}$ of $Q_3$, or the ratio "n" of the emitter areas, differ from the design center. FIG. 3 shows an arrangement for achieving this result by permitting non-interactive trimming adjustment of the resistors $R_1$, $R_3$, $R_4$ or $R_5$ to produce zero TC at a preselected desired output voltage Vo.

Figure 4:
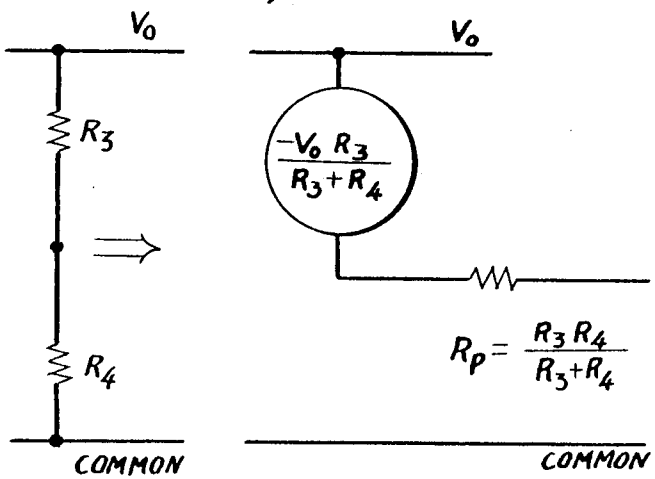
FIG. 4 is a diagrammatic showing of an equivalent circuit corresponding to a portion of the FIG. 2 and 3 circuit diagrams.

To aid in explaining the circuit of FIG. 3, FIG. 4 is included to show the two series-connected resistors $R_3$, $R_4$ from FIG. 3 together with an equivalent circuit for those resistors, as seen from the common node 28 and with respect to the output terminal 18, derived by application of Thevenin's Theorem. At an output voltage Vo, the open circuit voltage across $R_3$ will be $Vo \cdot R_3/(R_3+R_4)$. The equivalent impedance at the common node 28 will be just the parallel combination of $R_3$ and $R_4$ or: $R_p=R_3 \cdot R_4/(R_3+R_4)$. This leads to the composite equivalent circuit shown including a voltage source $-Vo\ R_3/(R_3+R_4)$ referred to Vo, and the equivalent series resistance $R_p$.

Referring to FIG. 2, the circuit shown there will operate as if this equivalent circuit (with its source voltage and resistance) were in place driving $R_5$. If the values $R_3$ and $R_4$ have been selected so that $R_5+R_p=R_2$ (from FIG. 1), i.e. the value which causes the circuit to operate with the band-gap voltage across the series combination of $Q_1$, $R_1$ and $R_2$, then the feedback loop will reach equilibrium when the equivalent circuit source voltage equals the band-gap voltage. That is, the loop balances when $V_{GO}=-Vo \cdot R_3/(R_3+R_4)$. Therefore, the output voltage can be selected as a multiple of the band-gap voltage by choosing the ratio of $R_3$ and $R_4$.

The FIG. 3 circuit is like the FIG. 2 circuit in most respects, but the diode $Q_3$ in FIG. 3 has been repositioned so that it is between the first pair of resistors $R_1$, $R_5$ and the common node 28 of the second pair of resistors $R_3$, $R_4$. The amplifier 10, just as in FIG. 2, forces a PTAT voltage to appear across the total network resistance composed of $R_1$, $R_5$, and $R_p$ (the equivalent circuit resistance at the $R_3$, $R_4$ node).

To facilitate trimming during manufacture, a probing pad terminal 30 is provided for the base/collector of the diode $Q_3$. Application of a proper control voltage to this terminal will pull the transistor base low so that the diode will disconnect the node 28 from the first pair of resistors $R_1$, $R_5$. $Q_1$ also will be cut off which will tend to drive down the amplifier output voltage Vo. However, as part of the trimming procedure, a forcing voltage is applied to the output terminal 18 to hold the amplifier output up.

When employing an amplifier 10 like that shown in the above copending application Ser. No. 178,121, the amplifier output can easily be held up by an external forcing voltage because the amplifier includes a follower output stage. The amplifier will overload harmlessly trying to make its output negative when $Q_1$ is cut off. In this condition, the ratio of $R_3$ to $R_4$ can be adjusted by measuring the voltage at the common node 28, as by means of a probing pad 32. A simple procedure is to force the output terminal to the desired output voltage (preferably by using a Kelvin connection because some current must be supplied), and then trimming $R_3$ or $R_4$ as required to produce the band-gap voltage across $R_3$. With this adjustment, the Thevenin equivalent voltage will be the band-gap voltage when the output Vo is at the desired voltage.

Upon removal of the forcing voltage from the amplifier output and removal of the reverse biasing from the base of $Q_3$, the circuit will be restored to normal operation. The output voltage Vo however probably will not be at the desired value, because the PTAT component of voltage across $R_1$, $R_5$ and $R_p$, added to the $V_{BE}$ of $Q_3$, probably will not equal the band-gap voltage. This can be corrected by trimming $R_1$ to lower the output voltage, or trimming $R_5$ to raise it. When the output voltage has been adjusted to the correct value, it will have zero TC (or nearly so) since the basic band-gap circuit consisting of $Q_1$, $R_1$, $R_5$ and $R_p$ will have the Thevenin equivalent band-gap voltage across it, stabilized by the amplifier feedback loop.

With this circuit arrangement, the common mode voltage applied to the inputs of the amplifier 10 will be ample to operate the amplifier and clear the current mirror 14 underneath. The performance of the circuit will be unaffected by the tail current of the transistor pair $Q_1$, $Q_2$.

Although the circuit of FIG. 3 performs well, there are as usual a few sources of small errors. For example, the base current of $Q_1$ flowing in $R_1$ results in a small error. The loop drives $R_1$ to produce $V_{BE}$ across it, and all the current required to do this should come from $R_5$ and $R_p$ to produce the band-gap voltage. The base current supplied by $Q_1$ reduces the current supplied by $R_5$ and $R_p$ to sustain $\Delta V_{BE}$ on $R_1$. This results in an output voltage deficiency of $ib(R_5+R_p)$. This is a small error but it can be corrected by inserting a resistor $R_6$ (not shown) in series with the base of $Q_2$. Assuming the base currents match, this will result in an increase in output voltage of: $R_6$ ib $(R_1+R_5+R_p)/R_1$. Equating this boost to the deficiency yields: $R_6=R_1(R_5+R_p)/(R_1+R_5+R_p)$. This result is a few percent low, since it neglects the effect of the RE of $Q_1$ which should be added to $R_p$ to be more exact. It can be calculated by dividing kT/q by the current in $R_5$ at the same temperature. This ib correction minimizes drift resulting from beta variability.

All the resistors for this circuit can be designed for their nominal value since both the trims are bidirectional, with a choice of "up" or "down" resistor. As a consequence, only a minimum trim range is required.

Figure 5:
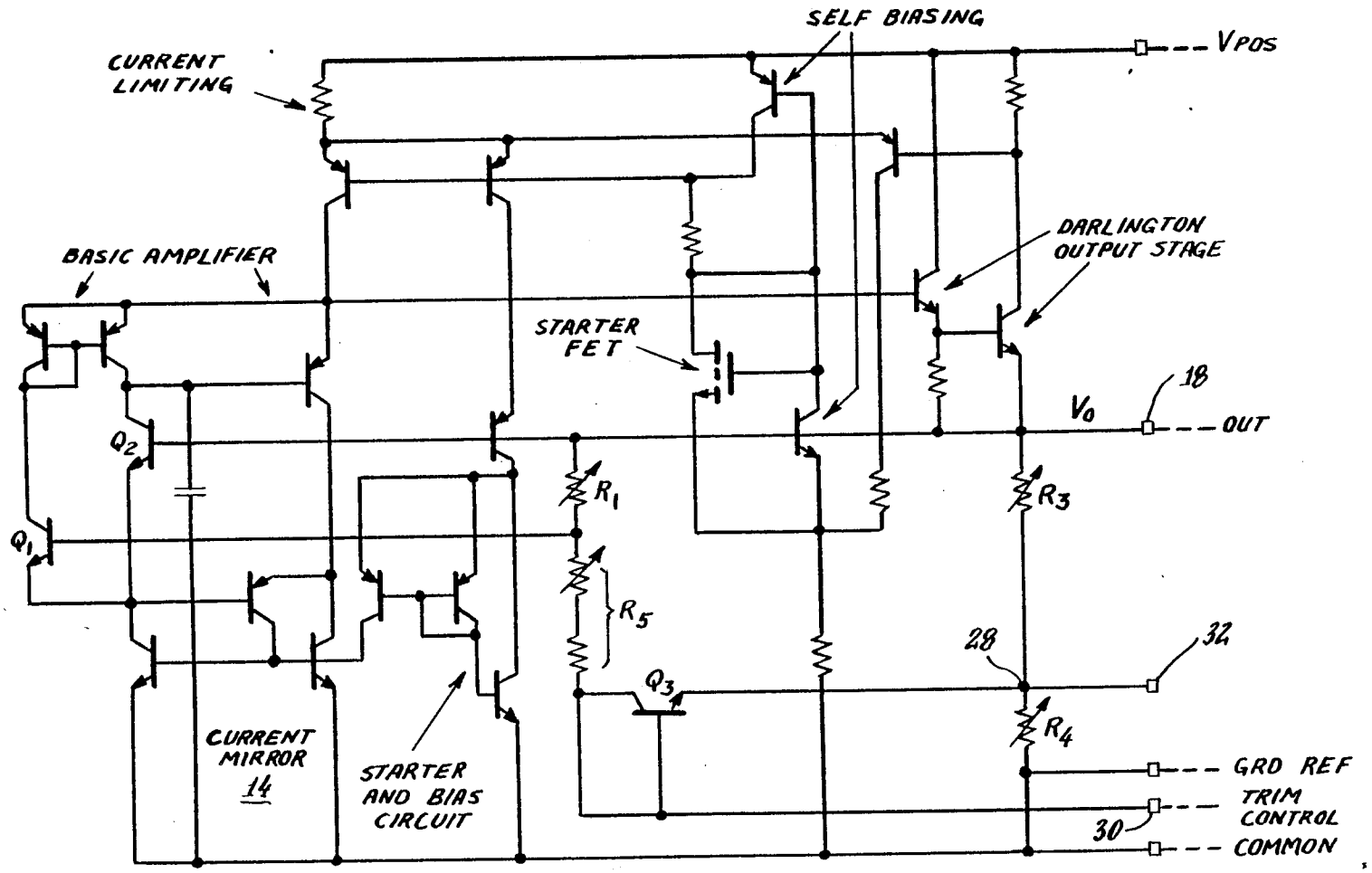
FIG. 5 is a circuit diagram illustrating the details of an embodiment of the invention as designed for commercial applications.

FIG. 5 shows a complete circuit diagram for a voltage reference of the type illustrated in FIG. 3. The components identified as $Q_1$, $Q_2$, $Q_3$, $R_1$, $R_3$, $R_4$ and $R_5$ correspond to the similarly identified components in FIG. 3. The amplifier circuit arrangement is much like that disclosed in the above copending application Ser. No. 78,121, and reference may be made to that application for a further detailed explanation of the manner of its functioning.

It ay be noted that $R_5$ has been divided into a thin film variable component and a diffused piece having a positive TC, to provide curvature correction as described in U.S. Pat. No. 4,250,445. To do a curvature trim, the nominal value of $R_1$ may be set a little low, and then trimmed up to cover variations in the relative sheet resistance of thin film and diffused resistors. It may in that case be convenient to place the diffused resistor between $R_1$ and the output, which may simplify measurement of the voltage across it without seriously affecting performance.

Although several preferred embodiments of the invention have been disclosed herein in detail, it is to be understood that this is for the purpose of illustrating the invention, and should not be construed as necessarily limiting the scope of the invention since it is apparent that many changes can be made by those skilled in the art while still practicing the invention claimed herein.

What is claimed is:

1. An IC band-gap voltage reference comprising:

a pair of transistors each having base, collector and emitter electrodes;

said emitter electrodes being connected together;

amplifier means coupled to said pair of transistors to produce an output signal responsive to the difference between the currents through said pair of transistors;

a feedback circuit coupled to said amplifier means and developing a feedback signal corresponding to said output signal;

a current mirror forming part of said feedback circuit and coupled to said pair of transistors to force the combined current through said transistor pair to track said feedback signal;

means to establish different current densities in the separate transistors of said pair of transistors;

an output circuit for said amplifier means and having an output terminal for developing a DC output voltage;

a network comprising resistor means and connected to said output circuit to carry a current corresponding to said output voltage;

means connecting the voltage across at least a part of said resistor means as a differential signal to said bases of said pair of transistors respectively to drive the current through said transistors to an equilibrium condition with the voltage between said transistor bases corresponding to the $\Delta V_{BE}$ voltage of said two transistors; and a transistor diode forming part of said network to provide that said output voltage is responsive to the combination of said $\Delta V_{BE}$ voltage and the $V_{BE}$ voltage of said diode, said output voltage thereby serving as a temperature-compensated reference voltage.

2. Apparatus as in claim 1, wherein said network comprises:

first and second resistor strings connected to said output circuit and interconnected to develop said output reference voltage as a predetermined multiple of the band-gap voltage.

3. Apparatus as in claim 2, wherein said first resistor string includes at least two series resistors and is connected at one end to said output terminal and at its other end to said second resistor string.

4. Apparatus as in claim 3, wherein said second resistor string comprises at least two series resistors with their common node connected to said other end of said first resistor string.

5. Apparatus as in claim 3, wherein said diode is connected in series with said first resistor string.

6. Apparatus as in claim 5, wherein said diode is connected between said first and second resistor strings.

7. Apparatus as in claim 6, wherein said diode is a transistor with interconnected base and collector; and terminal means to apply a control signal to the base/collector of said transistor/diode to effectively isolate said first and second resistor strings to provide for trimming of the resistors of said second resistor string.

8. Apparatus as in claim 6, wherein said second resistor string comprises at least two series resistors the common node of which is connected to said diode.

9. Apparatus as in claim 8, wherein said second resistor string is connected between said output terminal and a common terminal.

10. An IC band-gap voltage reference comprising:

a pair of transistors each having base, collector and emitter electrodes;

said emitter electrodes being connected together;

amplifier means having its input coupled to said pair of transistors to produce an output responsive to the difference between the currents through said pair of transistors;

means to produce different current densities in said pair of transistors;

an output circuit for said amplifier means and including an output terminal to develop an output voltage;

a first resistor string connected at one end to said output circuit to carry a current corresponding to said output voltage;

negative feedback means connecting the voltage across at least a part of said first resistor string as a differential signal to the bases of said pair of transistors respectively, to tend to drive said transistors toward equilibrium condition with the voltage between said bases corresponding to the $\Delta V_{BE}$ voltage of said transistors;

a diode connected with said first resistor string such that the diode $V_{BE}$ is in series with said $\Delta V_{BE}$ voltage;

a second resistor string connected a one end to said output circuit; and means connecting a common node of said second resistor string to the end of said first resistor string which is remote from said one end, thereby to develop at said output terminal a temperature-compensated voltage which is a predetermined multiple of the band-gap voltage.

11. Apparatus as in claim 10, wherein said first resistor string comprises at least two resistors in series with said diode.

12. Apparatus as in claim 11, wherein said diode is connected between said output terminal and said two-resistor string.

13. Apparatus as in claim 11, wherein one of said two resistors is connected to said output terminal;

said diode being connected between the other of said two resistors and said common node of said second resistor string.

14. Apparatus as in claim 13, wherein said second resistor string comprises two resistors the common node of which is connected to said diode.

15. Apparatus as in claim 14, including a terminal connected to one electrode of said diode to apply a control voltage thereto to isolate said first and second resistor strings to provide for trimming of the resistors of said second string.

16. An IC band-gap voltage reference comprising:

a pair of transistors each having base, collector and emitter electrodes;

amplifier means having its input coupled to said pair of transistors to produce an output responsive to the difference between the currents through said pair of transistors;

means to produce different current densities in said pair of transistors;

an output circuit for said amplifier means and including an output terminal to develop an output voltage;

a first string of at least two resistors connected at one end to said output circuit to carry a current corresponding to said output voltage;

a diode connected to the other end of said resistor string and developing a $V_{BE}$ voltage in series with the voltage across said first string resistors;

negative feedback means connecting the voltage across at least a part of said first resistor string as a differential signal to the bases of said pair of transistors respectively, to tend to drive said transistors towards an equilibrium condition with the voltage across said part of said resistor string corresponding to the $\Delta V_{BE}$ voltage of said pair of transistors and in series with said diode $V_{BE}$; and a resistor network connected to said output circuit and to said diode to develop at said output terminal a temperature-compensated reference voltage which is a multiple of the band-gap voltage.

17. Apparatus as in claim 16, wherein said resistor network comprises a second resistor string with at least two series-connected resistors having a common node connected to said diode.

18. Apparatus as in claim 17, wherein said second resistor string is connected between said output terminal and a common reference potential.

19. Apparatus as in claim 18, including a control terminal connected to one electrode of said diode to apply a control signal thereto to cut off said diode and thereby isolate said second resistor string from the first resistor string so as to provide for trimming the resistors of said second resistor string.

20. Apparatus as in claim 19, wherein said diode is a transistor with its collector and base connected together;

said terminal being connected to said collector/base.

* * * * *

UNITED STATES PATENT AND TRADEMARK OFFICE

CERTIFICATE OF CORRECTION

PATENT NO. : 4,902,959

DATED : February 20, 1990

INVENTOR(S) : Adrian Paul Brokaw

It is certified that error appears in the above-identified patent and that said Letters Patent is hereby corrected as shown below:

| | |
|---|---|
| Column 1, line 53 | After "transistors" insert --appears across a part of the amplifier output network which-- |
| Column 1, lines 54-56 | Delete --appears across a part of the amplifier output network which-- |

Signed and Sealed this

Twenty-third Day of August, 1994

*Attest:*

*Attesting Officer*

Bruce Lehman

BRUCE LEHMAN

*Commissioner of Patents and Trademarks*